US005369818A

United States Patent [19]

Barnum et al.

[11] Patent Number: 5,369,818

[45] Date of Patent: Dec. 6, 1994

[54] MULTI-LAVATORY SYSTEM

[75] Inventors: Thomas G. Barnum, Fox Point; Philip B. York, Thiensville; Thomas R. Eberhardy; John M. Gagas, both of Milwaukee, all of Wis.

[73] Assignee: Bradley Corporation, Menomonee Falls, Wis.

[21] Appl. No.: 63,278

[22] Filed: May 18, 1993

[51] Int. Cl.[5] ..... E03C 1/048

[52] U.S. Cl. ..... 4/624; 4/623; 4/640

[58] Field of Search ..... 4/639, 640, 623, 624

[56] References Cited

U.S. PATENT DOCUMENTS

| | | | |
|---|---|---|---|
| Re. 25,175 | 5/1962 | Nelson et al. | 4/670 |
| 206,454 | 7/1878 | Humphrey | 4/640 |
| 1,323,398 | 12/1919 | Leland | 4/640 |
| 2,028,802 | 1/1936 | Ottke | 4/640 X |
| 2,131,124 | 9/1938 | Smith | D23/273 X |
| 2,810,916 | 10/1957 | Cullen | 4/624 X |
| 2,836,080 | 5/1958 | Mullett | 4/624 X |
| 2,965,906 | 12/1960 | Mullett et al. | 4/624 |
| 2,992,437 | 7/1961 | Nelson et al. | 4/670 |
| 3,078,476 | 2/1963 | Doty et al. | 4/670 |
| 3,095,581 | 7/1963 | Gerow et al. | 4/670 |
| 3,098,241 | 7/1963 | Booker et al. | 4/670 |
| 3,333,284 | 8/1967 | Symmons | 4/670 |
| 3,728,745 | 4/1973 | Brendgard et al. | 4/624 |
| 3,765,036 | 10/1973 | Dykstra | 4/670 |
| 4,942,631 | 7/1990 | Rosa | 4/623 |
| 5,086,526 | 2/1992 | Van Marcke | 4/623 |

FOREIGN PATENT DOCUMENTS

| | | | |
|---|---|---|---|
| 1064436 | 8/1959 | Germany | 4/623 |
| 2304815 | 8/1974 | Germany . | |

*Primary Examiner*—Robert M. Fetsuga
*Attorney, Agent, or Firm*—Foley & Lardner

[57] ABSTRACT

A multi-lavatory system is preassembled to facilitate efficient installation with a minimum of connection points. The multi-lavatory system is connected to a single fluid supply line and a single drainage line. A fluid supply network conducts water from the single fluid supply line to a plurality of lavatory stations. Similarly, a drainage network conducts waste water from the plurality of lavatory stations to the single drainage line. Additionally, the multi-lavatory system includes a unitary lavatory subassembly having interconnected but spaced sink regions. Each sink region is disposed in one of the lavatory stations and is bounded at a frontal area by an upstanding contoured wall that creates an independent washing zone. This facilitates efficient production of the unitary lavatory subassembly and overall multi-lavatory system while providing each user of the system with a sense of privacy in their own independent washing zone.

18 Claims, 3 Drawing Sheets

MULTI-LAVATORY SYSTEM

TECHNICAL FIELD

The present invention relates generally to a multi-lavatory system providing washing areas for several users, and more particularly to a preassembled multi-lavatory unit having a minimal number of connection points for connecting the unit to water supply lines and drainage lines.

BACKGROUND OF THE INVENTION

Multiple wash basins are typically installed in non-residential applications. For instance, public restrooms or company restrooms will often have a plurality of wash basins so a number of people can simultaneously attend to their washing needs. If separate wash basins are installed, numerous components are required. Each wash basin must be mounted on the floor or wall independently, and separate plumbing, such as separate supply lines and drainage lines, must be connected for each wash basin. This results in a complex and time-consuming on-site installation which can dramatically increase the costs of constructing the restroom. Additionally, each wash basin unit must be separately measured and mounted to meet various building code requirements regarding, among other things, accessibility.

These problems are not new to the building industry nor have they escaped the attention of others. Various attempts have been made over the years to construct multiple wash basin systems. For example, in Humphrey, U.S. Pat. No. 206,454, issued Jul. 30, 1878, a washstand for factories, prisons, etc. is disclosed. That washstand includes a number of wash basins arranged across from each other so that several people can wash themselves at the same time. The wash basins are all filled and discharged simultaneously through a common feed pipe and a discharge pipe, respectively. This system, of course, would be impractical in modern day restrooms since there is no independent control for water flow to and drainage from each wash basin. Additionally, the system would be uncomfortable for people to use, since the system does not provide a sense of privacy, a factor known to be important when people use multiple wash basin systems in clear view of one another.

Another example is Leland, U.S. Pat. No. 1,323,398, issued Dec. 2, 1919, which shows a system having multiple wash basins disposed across from one another. A problem with this system is that it uses individual wash basins requiring the manufacture and assembly of a greater number of components. This results in inefficiency, both in manufacturing the separate wash basins and in the assembly of the system. Additionally, the overall structure does not provide a sense of privacy for the individuals using it. Also, it would be difficult to place the structure along a wall as commonly done in modern construction.

In Cullen, U.S. Pat. No. 2,810,916, issued Oct. 29, 1957, a lavatory is disclosed, having a plurality of wash basins arranged in circular fashion. This lavatory is designed to provide the greatest number of washing areas in a minimum amount of space for use in such applications as aboard ships. Accordingly, the individuals using the lavatory stand in a circle generally facing one another as they wash. Such a design provides no sense of privacy for the individuals using the wash basins and provides minimal space on which to set various toiletries. Additionally, such a design is not easily connected along a wall as is typical in most building construction.

Another system is shown in German Patent No. 2,304,815, dated Aug. 8, 1974. As illustrated by the figures in that patent, the system uses a modular construction having multiple wash basins. Again, the disclosure shows individual wash basins which are less efficient to manufacture and install. The triangular construction of the system also makes it less space efficient while requiring individual users to stand disposed at least partially towards one another.

The present invention overcomes various drawbacks of the prior art systems discussed above.

SUMMARY OF THE INVENTION

A preassembled multi-lavatory system according to the present invention is configured for connection to a single fluid supply line and to a single drainage line. The system comprises a base and a generally unitary lavatory subassembly mounted on the base. The lavatory subassembly includes at least two lavatory stations, each having a sink region. Each sink region is defined by an upstanding contoured wall which bounds at least the frontal area of each station to create an independent washing zone for a user. Between stations, the unitary lavatory subassembly is substantially unbounded. Each of the stations also includes a water inlet faucet mechanism and cooperates with a waste water drain.

The multi-lavatory system also includes a fluid supply network configured to provide a flow of fluid, typically water, to each faucet mechanism from a common fluid supply line. A drainage network is configured to conduct waste fluid from each of the waste fluid drains to a common main drainage line.

BRIEF DESCRIPTION OF THE DRAWINGS

The invention will hereafter be described with reference to the accompanying drawings, wherein like numerals denote like elements and.

DETAILED DESCRIPTION OF THE PREFERRED EMBODIMENTS

Figure 1:
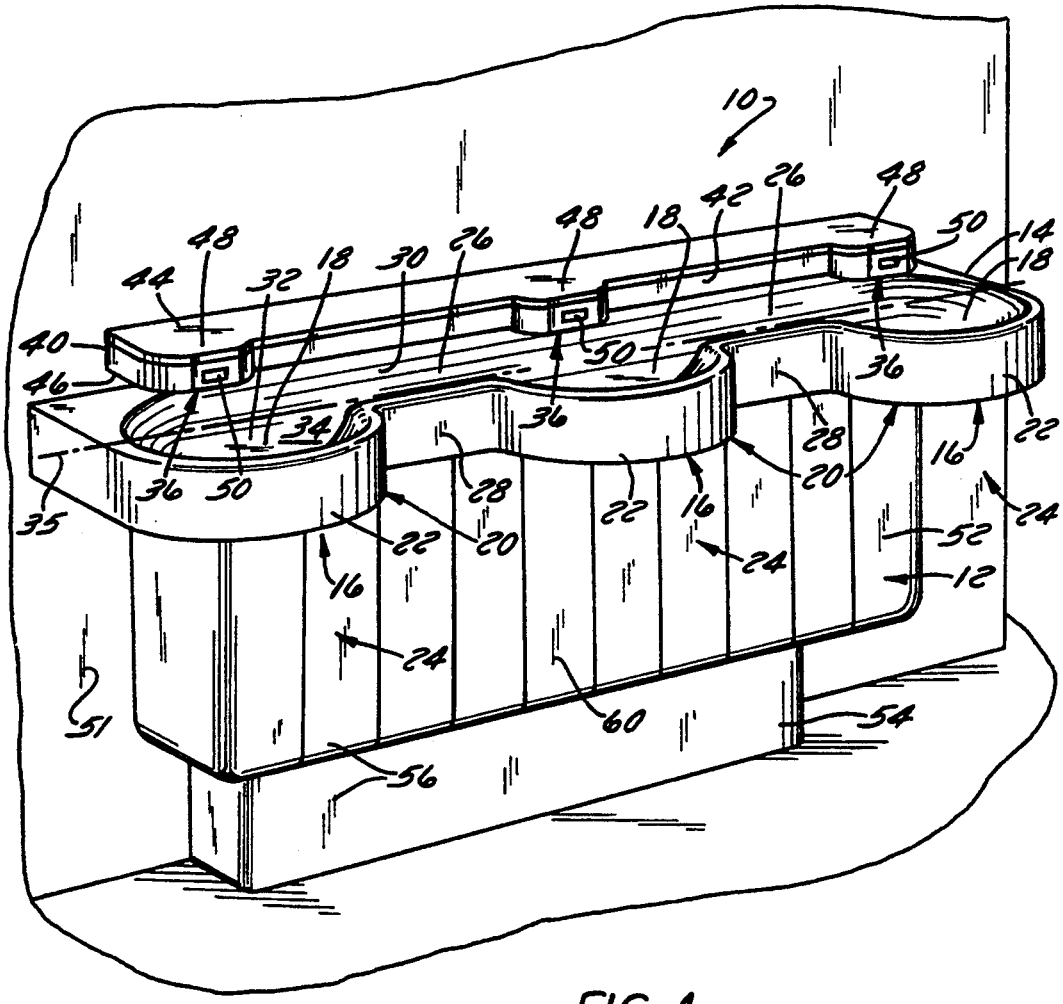
FIG. 1 is a perspective view of the preassembled multi-lavatory system according to the present invention.

Referring generally to FIG. 1, a multi-lavatory system 10 according to the present invention is an integral unit which can easily be attached along the wall of a restroom with a minimum of connection points. Multi-lavatory system 10 is a system of sinks formed in an integral unit and interconnected by common plumbing. The plumbing is contained and interconnected within multi-lavatory system 10 to provide minimal points of connection between system 10 and the external water supply and drainage lines. Also, the unique overall design allows a number of people to wash at the same integral unit while creating at least a psychological sense of privacy (as though each person was at his or her own washing area). Thus, multi-lavatory system 10 combines the advantages of an integral unit, which is efficient to manufacture and install, with a design that provides users the privacy they desire.

As shown in FIG. 1, multi-lavatory system 10 includes a base 12 on which is mounted a generally unitary lavatory subassembly 14. Lavatory subassembly 14 includes a plurality of lavatory stations 16. Each station includes a sink region 18 recessed therein and bounded through at least a frontal area 20 by an upstanding contoured wall 22. The contour of each wall 22 is designed to create an independent washing zone 24 for each user standing at one of the lavatory stations 16, in the illustrated embodiment, by extending the walls outwardly. Thus, unitary lavatory subassembly 14 is formed as a single piece, but separate contoured walls 22 divide it into distinct lavatory stations 16 so each user may stand in an independent washing zone 24 and be provided with a sense of privacy not attained when the users share a common sink region.

Preferably, there are three lavatory stations 16, but there could also be two lavatory stations 16 or more than three depending on the particular application. Adjacent lavatory stations 16 are laterally substantially unbounded. In other words, a channel 26 interiorly connects each sink region 18. Each channel 26 is bounded by an upstanding front wall 28, that extends between and connects contoured walls 22, and a back wall 30 which forms the back of unitary lavatory subassembly 14. Channels 26 and sink regions 18 are bounded underneath by a bottom 32 creating an overall recessed area 34 made of sink regions 18 and channels 26 combined. Since lavatory stations 16 are laterally substantially unbounded, water entering sink regions 18 can flow into channels 26 if the water level in recessed area 34 is sufficiently high. Preferably, each sink region 18 is sloped so water entering it will drain towards an adjacent channel 26. However, if the drainage were not permitted, water accumulating in recessed area 34 would extend uninterrupted from one sink region 18 to the next, e.g., water could flow from one sink region 18 to the next.

Preferably, sink regions 18, as well as contoured walls 22, are separated from each other by a spaced distance along a longitudinal axis 35. Thus, each person standing in an independent washing zone 24 will be facing in generally the same direction at a spaced distance from the next person using multi-lavatory system 10. In a preferred embodiment, each zone is spaced from its adjacent neighbors by a distance approximately the same as conventional spacing in public restrooms—about 30 inches.

Each lavatory station 16 has an independent water inlet faucet mechanism 36 to provide water to each sink region 18. Additionally, at least one drain 38 extends through bottom 32 to drain waste water from recessed area 34 (see FIG. 2). Preferably, one drain 38 is disposed through bottom 32 at each channel 26, although, drains 38 could also be formed through bottom 32 in direct cooperation with each sink region 18.

As illustrated, a shelf 40 is mounted over unitary lavatory subassembly 14 and includes a front 42, a shelf top 44, a shelf bottom 46, and a plurality of extended portions 48. Shelf 40 is mounted on back wall 30 and partially extends over sink regions 18 while extended portions 48 extend a greater distance over each sink region 18. Extended portions 48 are each configured to receive one faucet mechanism 36 appropriately mounted to provide water flow through an aperture 49 in shelf bottom 46 at each lavatory station 16 (see FIG. 3). Faucet mechanisms 36 may include conventional actuator levers (not shown) or other mechanisms for turning on the water, but preferably each include a sensor 50 mounted in front 42 at each extended portion 48. In the most preferred embodiment, sensor 50 is an infrared sensor, such as the Bradley Corporation Proximity Control, Bradley part No. 9500A-6501, which detects a user's hands placed in proximity to sink region 18 and provides an output to actuate a valve that allows water to flow through that particular faucet mechanism 36. The interaction of sensors 50 with faucet mechanisms 36 will be explained in detail below.

Unitary lavatory subassembly 14 is preferably made from a uniform material such as cast homogeneous thermoset polymer alloy comprised of polyester or acrylic or both, including customary fillers, colorants, etc. This uniform material is a strong material which does not need to be fully supported throughout its mass or around its perimeter. The homogeneous thermoset polymer material works well without a finishing coat and is easy and quick to clean. Lavatory subassembly 14 can be made from two materials comprising a base material covered by a waterproof coating, however, it is preferred that a uniform waterproof material be used since coatings can deteriorate or be scratched or worn off. A single uniform material also lends itself to a more efficient molding process which decreases the overall costs of making multi-lavatory system 10.

Base 12 supports unitary lavatory subassembly 14 and is preferably mounted to a wall 51, although it could be mounted to a combination of floor and wall. Base 12 includes an expanded segment 52 immediately beneath lavatory subassembly 14 and an inset segment 54 disposed between expanded portion 52 and the floor. Base 12 is inset along the floor to provide barrier free clearance for users in wheelchairs. The inset portion 54 and expanded portion 52 are preferably configured to meet the needs of all users and to satisfy A.D.A., ANSI, and UFAS requirements for barrier free clearances, reaches, and controls.

Both expanded portion 52 and inset portion 54 include an outer shell 56 which provides an aesthetically pleasing appearance. Shell 56 covers an internal framework 58 (see FIG. 2) which provides structural support for multi-lavatory system 10 and also a mounting structure for mounting multi-lavatory system 10 at a particular location along wall 51. Shell 56 prevents dirt and moisture from collecting on framework 58 and also provides a generally uniform, easy to clean surface 60 which facilitates maintenance of multi-lavatory system 10 in a sanitary condition.

Figure 2:
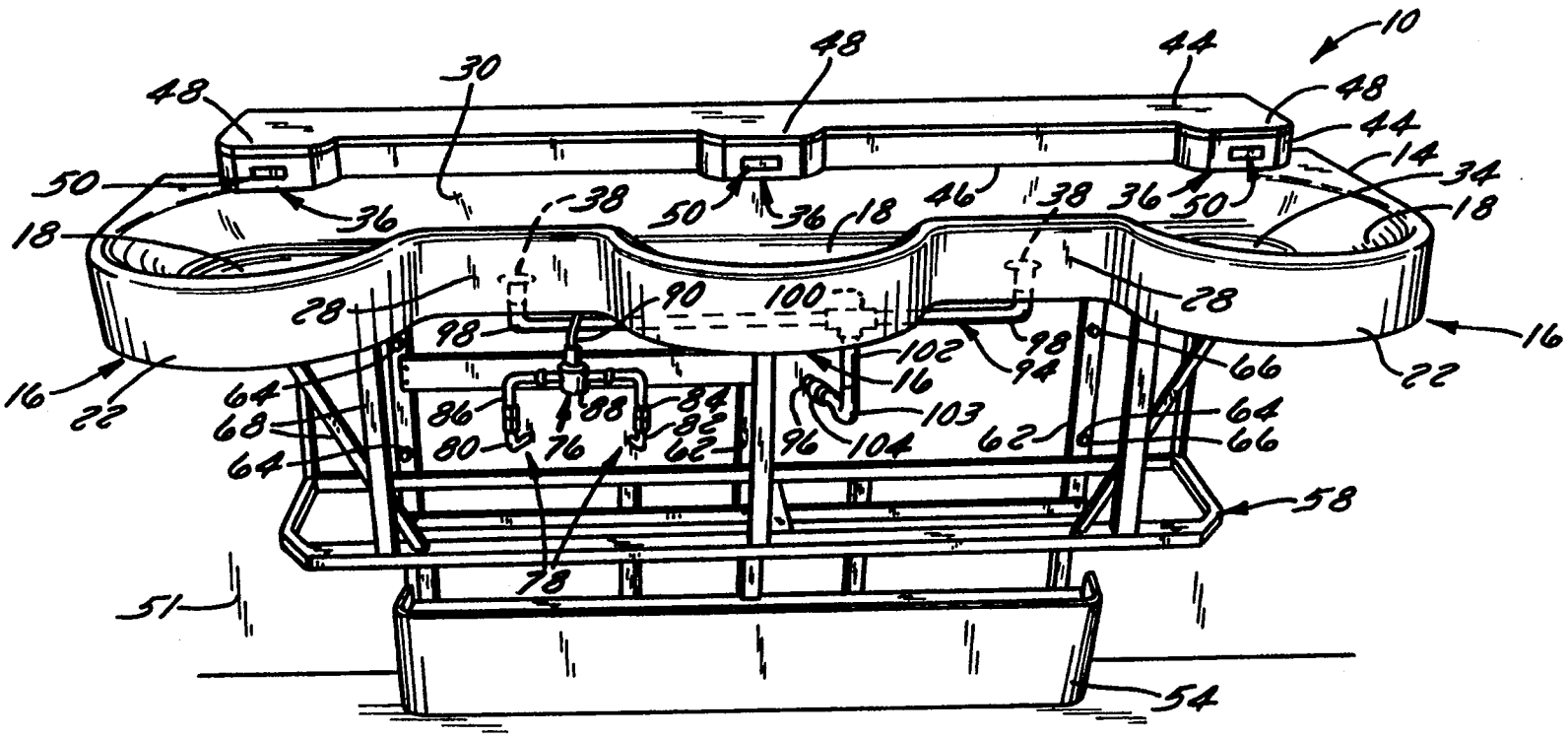
FIG. 2 is a view of the multi-lavatory system, similar to FIG. 1 but showing the system with the outer shell removed to expose the framework.

Framework 58 is illustrated in FIG. 2 and is configured to support unitary lavatory subassembly 14, to hold shell 56 in position, and to facilitate mounting of multi-lavatory system 10 to a wall or wall and floor. As shown, framework 58 includes a plurality of rear brackets 62, preferably three, having apertures 64 for receiving fasteners 66, such as bolts or screws, that securely hold framework 58 to the wall. In the most preferred embodiment, two fasteners 66 extend through each rear bracket 62. Framework 58 further includes a support structure 68 that extends outwardly from rear brackets 62 and away from wall 51 to both provide additional support for lavatory subassembly 14 and to hold shell 56 in its desired contour and position with respect to wall 51.

A fluid supply network 76 extends through framework 58 to supply water to faucet mechanisms 36. Fluid supply network 76 is connected to a single fluid supply line 78 having a hot water conduit 80 and a cold water conduit 82. The single fluid supply line 78, as described in this disclosure, provides a common supply of water for each sink region 18. Although single fluid supply line 78 includes hot water conduit 80 and cold water conduit 82, it is described as a single supply line since it alone provides the hot and cold water necessary to supply each sink region 18 with water.

A coupling 84 connects each conduit 80, 82 to a pipe 86. Pipes 86 are coupled to a mixer valve 88 that can be adjusted to provide the proper mixture of hot and cold water. Mixer valve 88 is preferably mounted to framework 58. A single hose 90 is connected to mixer valve 88 and extends up through lavatory subassembly 14 and shelf bottom 46 into a hollow region 92 disposed between shelf top 44 and shelf bottom 46. (See FIG. 3.)

In an alternate embodiment, mixer valve 88 could be installed separately from multi-lavatory system 10 by connecting it directly to the hot water conduit 80 and cold water conduit 82 within wall 51. In this configuration, only a single conduit would extend from wall 51 into framework 58 to cooperate with hose 90 and supply a proper mix of warm and cold water to faucet mechanisms 36.

A drainage network 94 also extends through framework 58 and is connected to a single drainage line 96 disposed in wall 51. Drainage network 94 is coupled to each drain 38 by a drain conduit 98. The drain conduits 98 are coupled to a junction 100 where waste water from each drain is combined. A single drain pipe 102 including a P-trap 103 is coupled between junction 100 and single drainage line 96 at a coupling 104 to conduct waste water out of multi-lavatory system 10. Although each drain could be connected to a separate drainage line at separate connection points, greater efficiency in installation is attained by providing a single drainage coupling 104. By designing the entire multi-lavatory system 10 for connection to a common fluid supply line 78 and a common drainage line 96, installation of lavatory system 10 is made simple and efficient.

Figure 3:
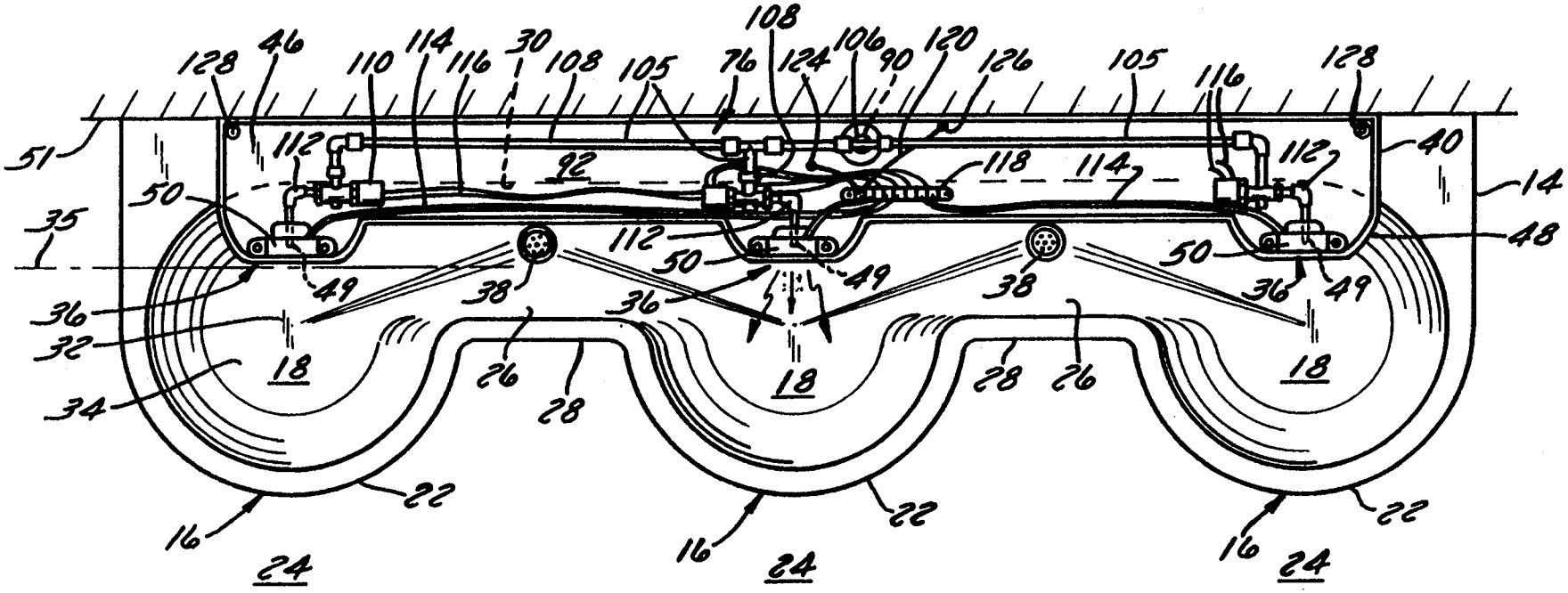
FIG. 3 is a top plan view of the multi-lavatory system with the top of the shelf removed.

Referring now generally to FIG. 3, the arrangement of components for controlling the delivery of water into each sink region 18 is illustrated. Fluid supply network 76 delivers water to faucet mechanisms 36 by a plurality of connector lines 105 connected to hose 90. Connector lines 105 are preferably connected to hose 90 by a splitter coupling 106 and include a plurality of hoses 108 each coupled to a delivery tube 112 by a solenoid valve 110. Splitter coupling 106 is configured to split the water flowing through hose 90 into at least two separate streams. Hoses 108 communicate with splitter coupling 106 and extend along hollow region 92 into proximity with each extended portion 48. Generally within or adjacent to each extended portion 48, one hose 108 is coupled to one of the solenoid valves 110. The solenoid valve 110 selectively permits fluid flow in response to an output signal from sensor 50 when a user inserts a hand or other body part into sink region 18. Each solenoid valve 110 is connected to its respective faucet mechanism 36 by one of the tubes 112. Thus, to operate multi-lavatory system 10, a user stands at one of the lavatory stations 16 and inserts his or her hands into sink region 18, the appropriate sensor 50 cooperating with that sink region 18 provides an output signal to the appropriate solenoid valve 110 which, in turn, opens and allows water flow through faucet mechanism 36 to provide water to the user.

Depending on the type of sensor used in a particular lavatory system 10, a plurality of electric lines 114 are connected to each sensor 50 to power it and to carry the output signal. Similarly, a plurality of electric lines 116 are connected to each solenoid valve 110 to appropriately activate it in response to the output signal. Preferably, electric lines 114 and 116 are all connected to a single junction box 118. In this manner, the junction box can be powered by a single electrical cord 120 preferably having a connection plug 126. This also facilitates ease of installation since the solenoid valves 110 and sensors 50 can be powered by plugging in one plug 126 to an appropriate power supply line, typically a reduced voltage line such as a 24 volt AC line (not shown). Cord 120 can also be connected to the electrical system of a building directly without the use of plug 126.

As further illustrated in FIG. 3, shelf 40 and unitary lavatory subassembly 14 are preferably connected together and fastened to framework 58 by a plurality of fasteners 128. Lavatory subassembly 14 may be fastened to support structure 68 at various other points, if necessary, to provide greater rigidity.

The overall design of multi-lavatory system 10 provides a preassembled unit which is simple to install. Since it is a single unit mounted along the wall, there is no need to tile the wall in the area against which multi-lavatory system 10 is mounted. This eliminates the time consuming tile cutting that would otherwise be necessary when mounting a conventional bathroom unit. Multi-lavatory system 10 also has a minimal number of plumbing and electrical connections and a minimal number of connection points for attachment to wall 51. In the most preferred embodiment, multi-lavatory system 10 supplies water to a plurality of lavatory stations 16 from a single water supply line 78 having a hot water conduit and a cold water conduit. Similarly, multi-lavatory system 10 is preferably connected to a single drainage line 96 through which the waste water from each lavatory station 16 is expelled. Also, if electrically powered sensors 50 and solenoid valves 110 are used, insertion of a single electrical plug 26 into a power supply will power the entire multi-lavatory system 10. These single connection points make installation of multi-lavatory system 10 fast and efficient.

In addition to the ease of installation, multi-lavatory system 10 incorporates a unitary lavatory subassembly 14 that is efficient to manufacture while providing independent washing zones 24 so that users can attend to their washing needs at an individual lavatory station 16. This provides each user with an adequate sense of privacy while washing at a spaced distance from the next person using multi-lavatory system 10.

It will be understood that the foregoing description is of preferred exemplary embodiments of this invention, and that the invention is not limited to the specific forms shown. For example, the shelf could be omitted and the faucet mechanisms mounted directly on the unitary lavatory subassembly, various sensors, such as infrared, optoelectronic, or other non-contact type sensors, could be used, and other types of valves, such as traditional lever actuated valves, could also be used. Additionally, unitary lavatory subassembly 14 could be made from a variety of materials, the upstanding contoured walls could have different types of contours, and the drains could be placed in a variety of locations. These and other modifications may be made in the design and arrangements of the elements without departing from the scope of the invention as expressed in the appended claims.

We claim:

1. A preassembled multi-lavatory system configured for connection between a single fluid supply line fed by a hot water conduit and a cold water conduit, and a single drainage line, the system comprising:

a base;

a generally unitary lavatory subassembly mounted on said base, comprised of at least three lavatory stations and a fluid flow channel extending therebetween, the fluid flow channel being bounded by channel walls, each of said stations including a sink region defined within a back wall and an upstanding contoured wall bounding at least the frontal area of each said station to create an independent washing zone for a user, each said upstanding contoured wall being oriented in the same direction and arcuate, the arc of each said upstanding contoured wall extending through at least 120 degrees, said stations being in fluid communication with said fluid flow channel and laterally substantially unbounded therebetween, each of said stations further including a water inlet faucet mechanism and each of said stations being in communication with a waste fluid drain, wherein the greatest span between the channel walls is less than the greatest span between the back wall and each upstanding contoured wall;

a fluid supply network configured to provide a flow of fluid to each of said faucet mechanisms from said fluid supply line; and a drainage network configured to conduct fluid from each of said station waste fluid drains to said drainage line.

2. The preassembled multi-lavatory system of claim 1, wherein said fluid supply network is configured to be coupled to said fluid supply line at a pair of coupling points, and further wherein hot water flows through one coupling point and cold water flows through the other coupling point.

3. The preassembled multi-lavatory system of claim 2, wherein said drainage network is configured to be connected to said single drainage line at a single coupling.

4. The preassembled multi-lavatory system of claim 3, wherein the fluid network includes a plurality of connector lines, one line being connected to each of said faucet mechanisms.

5. The preassembled multi-lavatory system of claim 4, further comprising a plurality of solenoid valves, wherein one solenoid valve is disposed in each connector line to selectively permit fluid flow therethrough.

6. The preassembled multi-lavatory system of claim 5, further comprising a plurality of sensors configured to sense when an individual's hands are placed into one of said sink regions and to provide an output signal in response thereto, wherein one of the solenoid valves is connected to each sensor to permit fluid flow to that sink region in response to said signal.

7. The preassembled multi-lavatory system of claim 6, wherein said sensors are infrared sensing modules.

8. The preassembled multi-lavatory system of claim 6, further comprising a shelf mounted on said unitary lavatory subassembly, said shelf having a top, a bottom, and a hollow region therebetween, said bottom including apertures in which said faucet mechanisms are mounted, wherein said connector lines, said solenoid valves, and said sensors are disposed in said hollow region.

9. The preassembled multi-lavatory system of claim 1, wherein said fluid supply network is coupled to a single conduit supplying a mixture of hot and cold water.

10. The preassembled multi-lavatory system of claim 1, wherein said base includes a framework surrounded by a shell, said framework being configured for attachment along a wall.

11. The preassembled multi-lavatory system of claim 10, wherein said base includes an inset portion along its bottom to facilitate access by individuals in wheelchairs.

12. A preassembled multi-lavatory unit configured for connection between a water supply and a drain, the multi-lavatory system comprising:

a base having a framework covered at least partially by an outer shell;

a generally unitary lavatory subassembly mounted on said base, comprised of at least three lavatory stations and a fluid flow channel extending therebetween, the fluid flow channel being bounded by channel walls, each of said stations including a sink region defined within a back wall and an upstanding contoured wall bounding at least the frontal area of each said station to create an independent washing zone for a user, each said upstanding contoured wall being oriented in the same direction and arcuate, the arc of each said upstanding contoured wall extending through at least 120 degrees, said stations being in fluid communication with said fluid flow channel and laterally substantially unbounded therebetween, each of said stations further including a water inlet faucet mechanism and each of said stations being in communication with a waste fluid drain, wherein the greatest span between the channel walls is less than the greatest span between the back wall and each upstanding contoured wall, wherein said unitary lavatory subassembly is mounted on said base;

a water supply network which supplies water to each of said stations, said supply network having fewer than three supply connection points at which said preassembled multi-lavatory unit is connected to said water supply; and a drainage network which drains water from each sink region, said drainage network having fewer than three drainage connection points at which said preassembled multi-lavatory unit is connected to said drain.

13. The preassembled multi-lavatory unit of claim 12, wherein said supply network has one supply connection point.

14. The preassembled multi-lavatory unit of claim 12, wherein said drainage network has one drainage connection point.

15. The preassembled multi-lavatory unit of claim 14, further comprising a plurality of solenoid valves connected to said supply network to regulate water flow to said stations.

16. The preassembled multi-lavatory unit of claim 15, further comprising a plurality of sensors connected to said plurality of solenoids, wherein said sensors detect when a person's hands are inserted into one of said sink regions and provide an output signal to the appropriate cooperating solenoid to permit water flow to that sink region.

17. The preassembled multi-lavatory unit of claim 16, further comprising a shelf mounted on said unitary lavatory subassembly, said shelf including a top, a bottom having a plurality of apertures therethrough, and a hollow interior region, wherein said apertures are disposed above said sink regions and configured to receive said faucet mechanisms.

18. The preassembled multi-lavatory unit of claim 17, wherein said solenoids and said sensors are disposed in said hollow interior region.

* * * * *